US010786060B2

(12) United States Patent
Reile

(10) Patent No.: US 10,786,060 B2
(45) Date of Patent: Sep. 29, 2020

(54) HAIRSTYLE ENHANCING ACCESSORY

(71) Applicant: Phyllis A. Reile, Notasulga, AL (US)

(72) Inventor: Phyllis A. Reile, Notasulga, AL (US)

( * ) Notice: Subject to any disclaimer, the term of this patent is extended or adjusted under 35 U.S.C. 154(b) by 0 days.

(21) Appl. No.: 14/628,049

(22) Filed: Feb. 20, 2015

(65) Prior Publication Data

US 2016/0242522 A1 Aug. 25, 2016

(51) Int. Cl.

| | |
|---|---|
| ***A45D 8/00*** | (2006.01) |
| ***A45D 8/38*** | (2006.01) |
| ***A45D 8/34*** | (2006.01) |

(52) U.S. Cl.

CPC *A45D 8/38* (2013.01); *A45D 8/34* (2013.01)

(58) Field of Classification Search

CPC ... A45D 2/08; A45D 2/10; A45D 2/12; A45D 2/125; A45D 2/127; A45D 2/14; A45D 2/146; A45D 2/148; A45D 2/2464; A45D 2/2485; A45D 2/36; A45D 8/00; A45D 8/34; A45D 8/38

See application file for complete search history.

(56) References Cited

U.S. PATENT DOCUMENTS

| | | | | |
|---|---|---|---|---|
| 566,779 A | | 9/1896 | Liebreich | |
| 731,575 A | | 6/1903 | Johnston | |
| 2,388,628 A | * | 11/1945 | Wormington | A45D 2/10 132/219 |
| 2,393,376 A | | 1/1946 | Holden | |
| 2,433,141 A | | 12/1947 | McPherson | |
| 2,537,728 A | * | 1/1951 | Wright | A45D 2/125 132/248 |
| 2,555,933 A | | 6/1951 | Winstrom | |
| 2,595,657 A | | 5/1952 | Harmon | |
| 2,623,530 A | | 12/1952 | Solomon | |
| 2,625,941 A | | 1/1953 | Harrington | |

(Continued)

FOREIGN PATENT DOCUMENTS

KR 101356661 B1 2/2014

OTHER PUBLICATIONS

Hair Bun Ring—www.DHgate.com—retrieved from Internet on Jan. 16, 2015; http://www.dhgate.com/product/cheapest-20-pcs-lot-brand-new-hair-bun-ring/142569243.html.

(Continued)

*Primary Examiner* — Rachel R Steitz

(74) *Attorney, Agent, or Firm* — Jonathan C. Hill; Jake M. Gipson; Bradley Arant Boult Cummings LLP

(57) ABSTRACT

A hair enhancing accessory is used during formation of a hairstyle such as a ponytail or a bun. The hair enhancing has a base rim which is placed next to or near the head and a body which adds volume to a chosen hairstyle, allowing hair to be positioned around the body. The body is separated into a lower body section and an upper body section. The lower body section and upper body section can combine to form a cylindrical lateral surface, a tapered lateral surface, or even two oppositely tapered surfaces that meet at a midsection. Potentially, a secondary lip can be incorporated adjacent to the upper body section. A hair retaining addition such as a hair band is used to secure hair around the body, and is prevented from sliding by the base rim, the secondary rim, the tapered body sections, or a combination thereof.

8 Claims, 11 Drawing Sheets

(56) References Cited

U.S. PATENT DOCUMENTS

| | | | | |
|---|---|---|---|---|
| 2,682,878 | A * | 7/1954 | Pisciotta | A45D 2/10 132/242 |
| 2,713,864 | A | 7/1955 | Solomon | |
| 2,796,069 | A | 6/1957 | Mooney, Jr. | |
| 2,825,344 | A * | 3/1958 | Lenois | A45D 2/125 132/250 |
| 3,200,824 | A | 8/1965 | Coloccia | |
| 3,301,265 | A | 1/1967 | Brenn-Albertoni | |
| 3,388,709 | A | 6/1968 | Morris | |
| 3,533,418 | A | 10/1970 | Mestral | |
| 3,747,610 | A * | 7/1973 | Serrat | A45D 2/10 132/268 |
| 3,805,810 | A | 4/1974 | Savala | |
| D248,075 | S * | 6/1978 | Daenen | D7/523 |
| 4,372,329 | A | 2/1983 | Brown, Jr. | |
| 5,076,299 | A | 12/1991 | Wistrand et al. | |
| 5,494,059 | A | 2/1996 | Barrows et al. | |
| 5,584,309 | A | 12/1996 | De Beneditis et al. | |
| 5,706,837 | A | 1/1998 | Iwata | |
| 5,769,101 | A | 6/1998 | Iwata | |
| 5,845,657 | A | 12/1998 | Carberry et al. | |
| 5,937,867 | A | 8/1999 | Williams | |
| 6,047,708 | A | 4/2000 | Panel et al. | |
| 6,089,240 | A | 7/2000 | Chang | |
| 6,182,921 | B1 | 2/2001 | Muylle et al. | |
| 6,276,368 | B1 | 8/2001 | Giamalva | |
| 6,647,284 | B1 * | 11/2003 | Lee | G01J 5/02 374/158 |
| 6,990,986 | B2 | 1/2006 | Valentini | |
| 7,004,179 | B1 | 2/2006 | Lunde | |
| D533,355 | S | 12/2006 | Rusk | |
| 7,963,289 | B1 | 6/2011 | King | |
| D657,197 | S * | 4/2012 | McCleary | D7/515 |
| 8,505,555 | B1 | 8/2013 | Lightfoot-Martin | |
| 8,517,033 | B2 | 8/2013 | Martinelli | |
| 8,671,957 | B1 * | 3/2014 | James | A45D 2/10 132/247 |
| 8,789,537 | B2 | 7/2014 | Loredo | |
| 10,022,004 | B2 * | 7/2018 | Taormina | A47G 19/23 |
| 2009/0071497 | A1 | 3/2009 | Szlanfucht et al. | |
| 2009/0194129 | A1 | 8/2009 | Junemann | |
| 2010/0012138 | A1 | 1/2010 | Ruckdeschel | |
| 2010/0078036 | A1 | 4/2010 | Naji | |
| 2011/0132942 | A1 | 6/2011 | Choi | |
| 2011/0180094 | A1 | 7/2011 | Greenwald | |
| 2011/0253165 | A1 | 10/2011 | Kenna | |
| 2012/0061395 | A1 * | 3/2012 | Imo | B65D 51/08 220/376 |
| 2012/0138077 | A1 | 6/2012 | Stuhler | |
| 2012/0174942 | A1 | 7/2012 | Carey | |
| 2012/0186601 | A1 * | 7/2012 | Ungar | A45D 2/08 132/273 |
| 2012/0211020 | A1 | 8/2012 | Garcia | |

OTHER PUBLICATIONS

International Search Report for PCT/IB2015/059089 dated Feb. 23, 2016.

Written Opinion for PCT/IB2015/059089 dated Feb. 23, 2016.

* cited by examiner

HAIRSTYLE ENHANCING ACCESSORY

FIELD OF THE INVENTION

The present invention relates generally to an accessory that is incorporated into hairstyles in order to provide an enhanced visual effect. Effectively, the present invention helps to give the impression of a larger hairstyle.

BACKGROUND OF THE INVENTION

Hairstyles are an area of importance to many people, who spend countless dollars on products that help maintain, improve, or accessorize various hairstyles. One aspect of improvement that is desirable is giving the appearance of a larger of fuller hairstyle. Common examples of hairstyles that benefit from such a visual improvement are ponytails and buns. The present invention serves to effectively enlarge a hairstyle by providing a core body around which to build the hairstyle. The present invention additionally serves to extend hairstyles such as ponytails and buns, allowing them to push farther back and out before dropping due to the effects of gravity.

It is therefore an object of the present invention to provide an accessory which allows hairstyles to be enhanced in a simple and ergonomic manner.

DETAIL DESCRIPTIONS OF THE INVENTION

Figure 1:
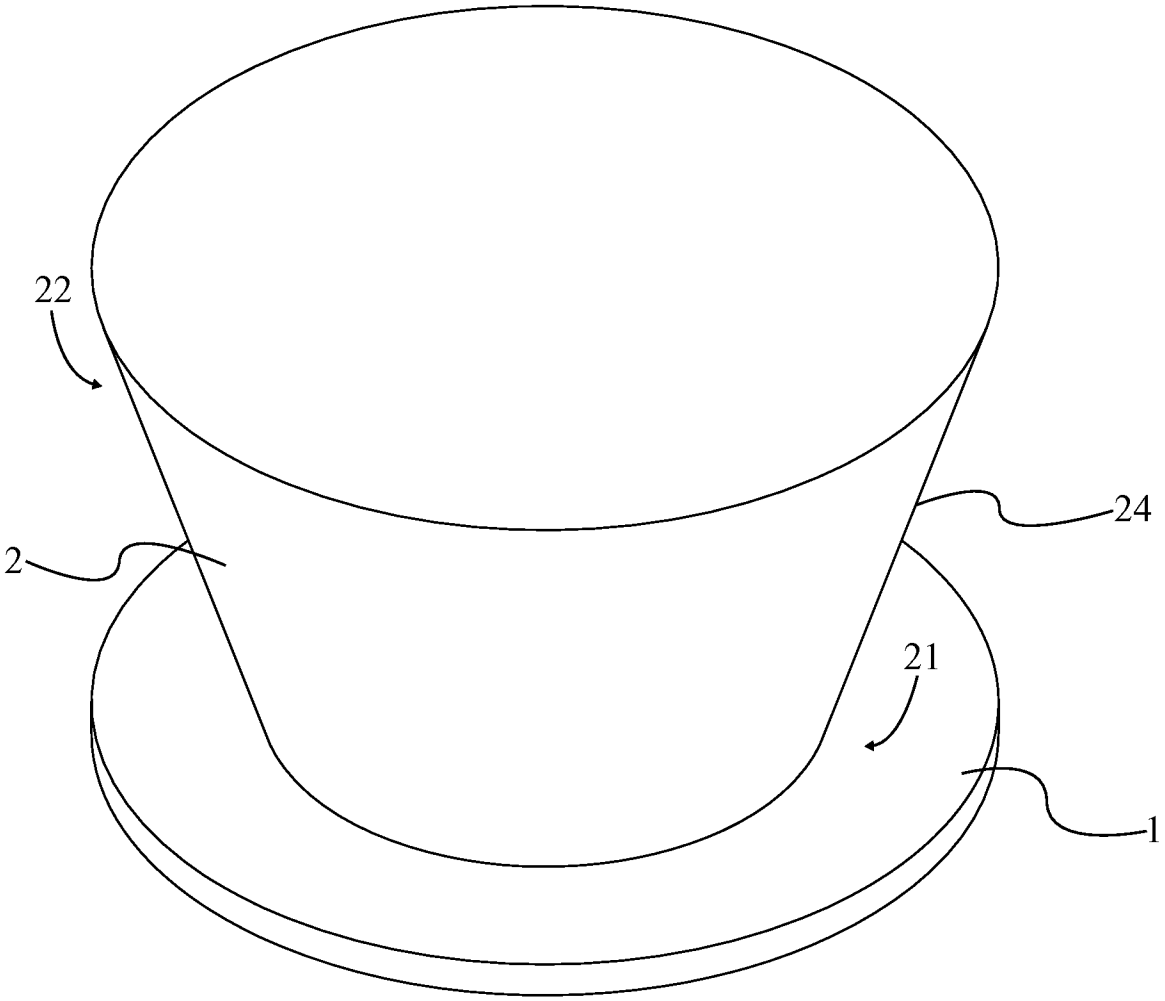
FIG. 1 is a perspective view of an embodiment of the present invention with a tapered lateral surface.
Figure 2:
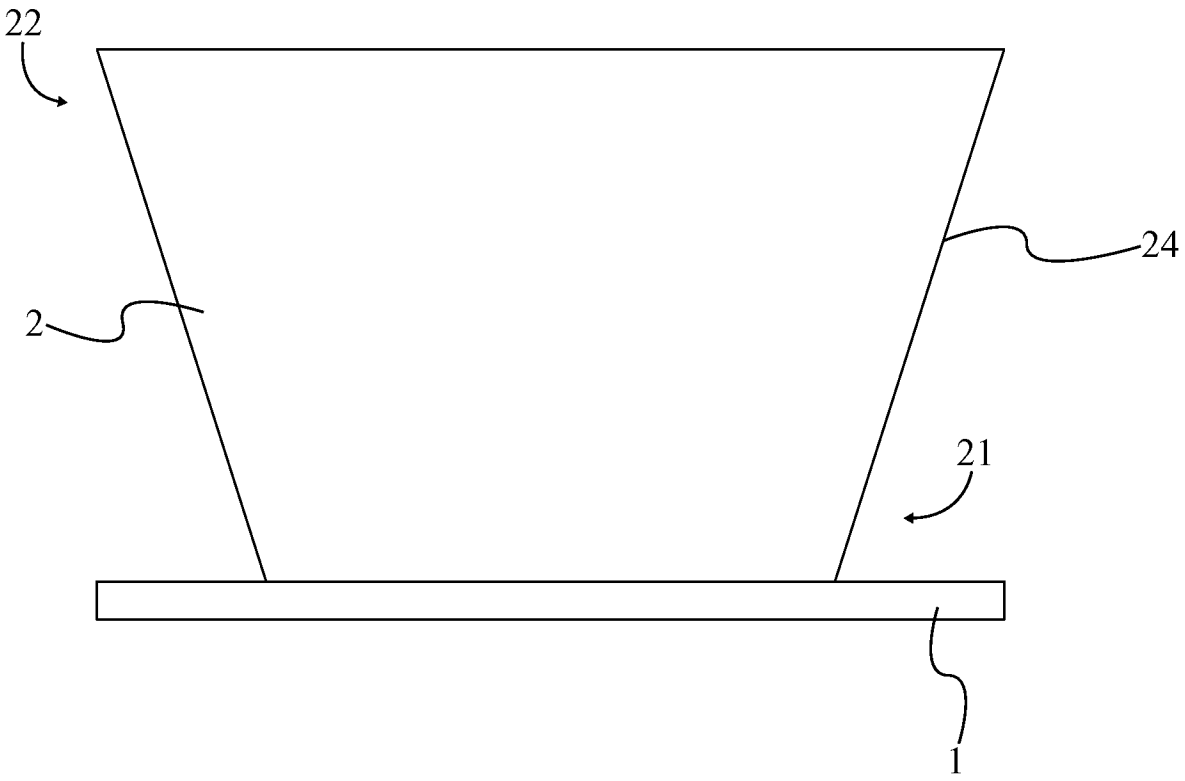
FIG. 2 is a side view thereof.
Figure 3:
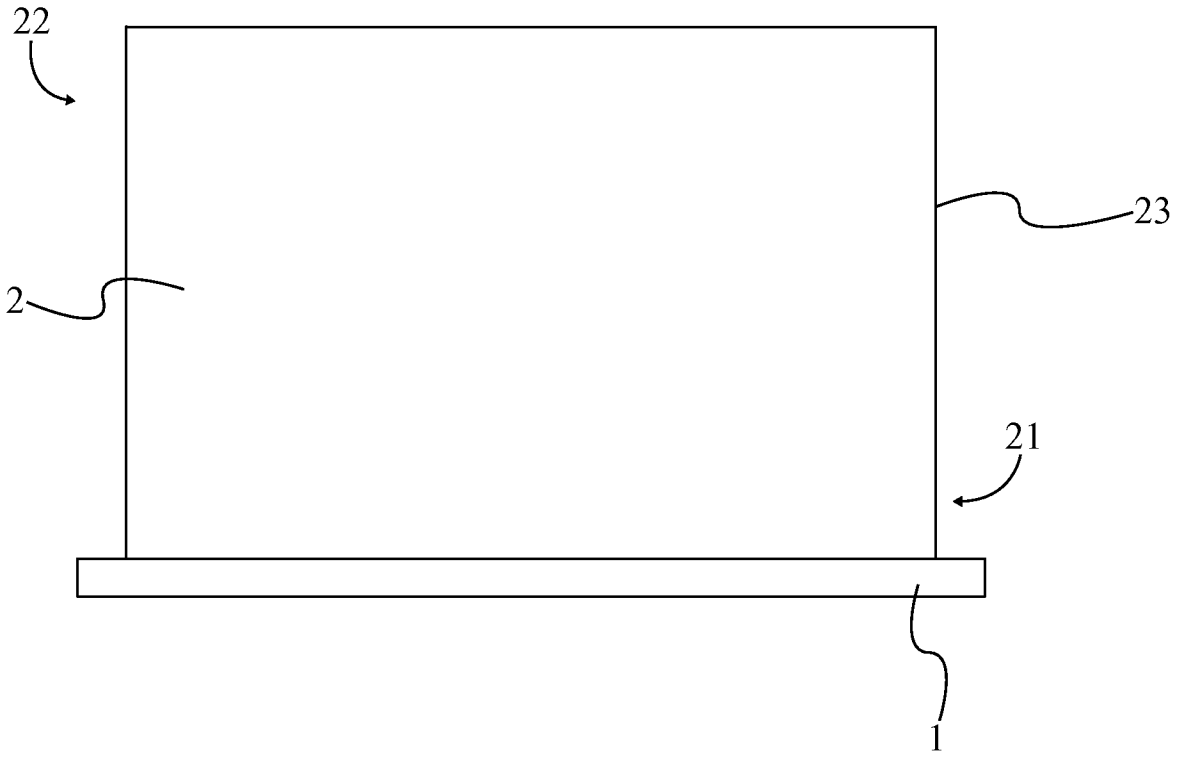
FIG. 3 is a side view of an embodiment of the present invention with a cylindrical lateral surface.

All illustrations of the drawings are for the purpose of describing selected versions of the present invention and are not intended to limit the scope of the present invention.

The present invention is a hairstyle enhancing accessory that is used to effectively enlarge various hairstyles, examples of which include ponytails and buns. The present invention comprises a base rim 1 which is connected to a body 2. The body 2 itself comprises a lower body section 21, and an upper body section 22. The lower body section 21 is adjacently connected to the base rim 1, the latter of which is pressed against the back of a user's head. On the other side of the lower body section 21, opposite the base rim 1, is the upper body section 22. The upper body section 22 is adjacently connected to the lower body section 21 such that the base rim 1, lower body section 21, and upper body section 22 form a singular body 2. More specifically, the lower body section 21 and upper body section 22 are joined at their perimeter to create the impression of a unitary and continuous body 2. This resulting unitary body 2 is used to fluff up the appearance of certain hairstyles by providing the appearance of more volume. For example, ponytails and buns that utilize the present invention appear "fuller", "thicker", or "more voluptuous" than those made without the present invention. Different embodiments are shown via FIG. 1-FIG. 7, while FIG. 8-FIG. 11 illustrate the volume enhancing effect of the present invention.

Different embodiments of the present invention are possible based on different configurations of the basic components heretofore described. In one embodiment of the present invention, the lower body section 21 and upper body section 22 are joined in a manner that results in the body 2 being a continuous piece with linear walls. the lower body section 21 and the upper body section 22 are connected to each other in a way that forms a cylindrical lateral surface 23. Alternatively, the lateral surface can be tapered towards the base rim 1, with the body 2 being widest as the upper body section 22 narrowest at the lower body section 21 adjacent to the base rim 1. The body 2 gradually narrows from the upper body section 22 to the lower body section 21 and from the lower body section 21 to the base rim 1, resulting in the formation of a tapered lateral surface 24. The tapered variant can be considered more advantageous as it is better at preventing undesired movement of a hair band or similar item, as discussed later. This shows how the body 2, including component lower body section 21 and upper body section 22, can be implemented in different manners yet still result in a continuous piece with linear walls as described by the first embodiment. Examples of the first embodiment are provided in FIG. 1-FIG. 3.

In a second embodiment, the lower body section 21 and upper body section 22 are not joined in a linear fashion, resulting in a body 2 with angled or curved portions. In this second embodiment, the lower body section 21 and the upper body section 22 thus taper towards each other, meeting at a narrow midsection of the body 2. The visual result is that of a two pyramids being joined at a point, having a resemblance to the profile of an hour glass. Effectively, the lower body section 21 is one pyramid and the upper body section 22 is a second pyramid. To help further define this, a reference plane 4 can be visualized, with the reference plane 4 bisecting the lower body section 21 and the upper body section 22. The upper body section 22 is thus considered as being a mirror image of the lower body section 21, reflected across the reference plane 4. Some variation to the created body 2 of the second embodiment is possible. For example, the upper body section 22 and lower body section 21 can be made symmetrical or asymmetrical to each other, with symmetry being evaluated across the reference plane 4.

Figure 4:
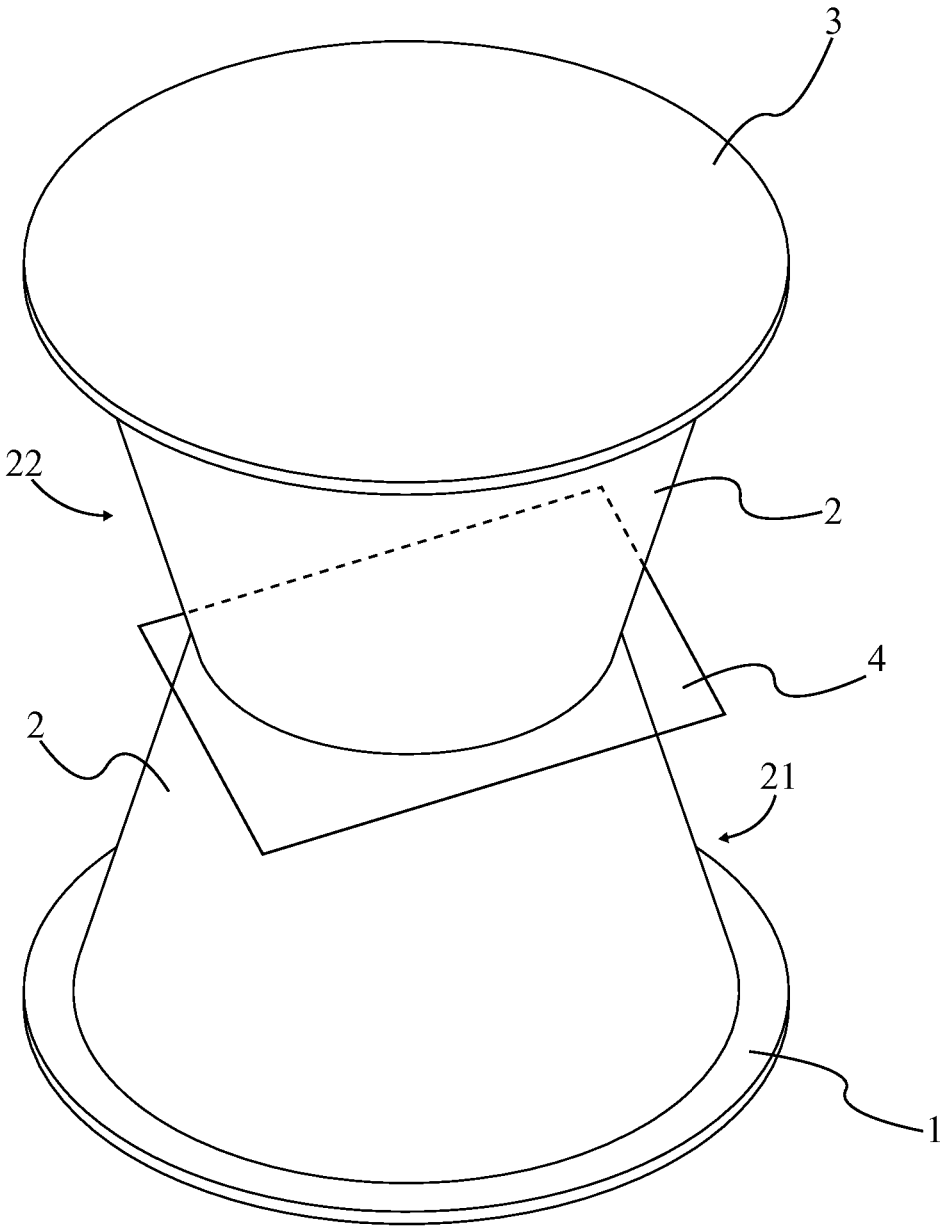
FIG. 4 is a perspective view showing an embodiment of the present invention with oppositely tapered body sections and a secondary rim.
Figure 5:
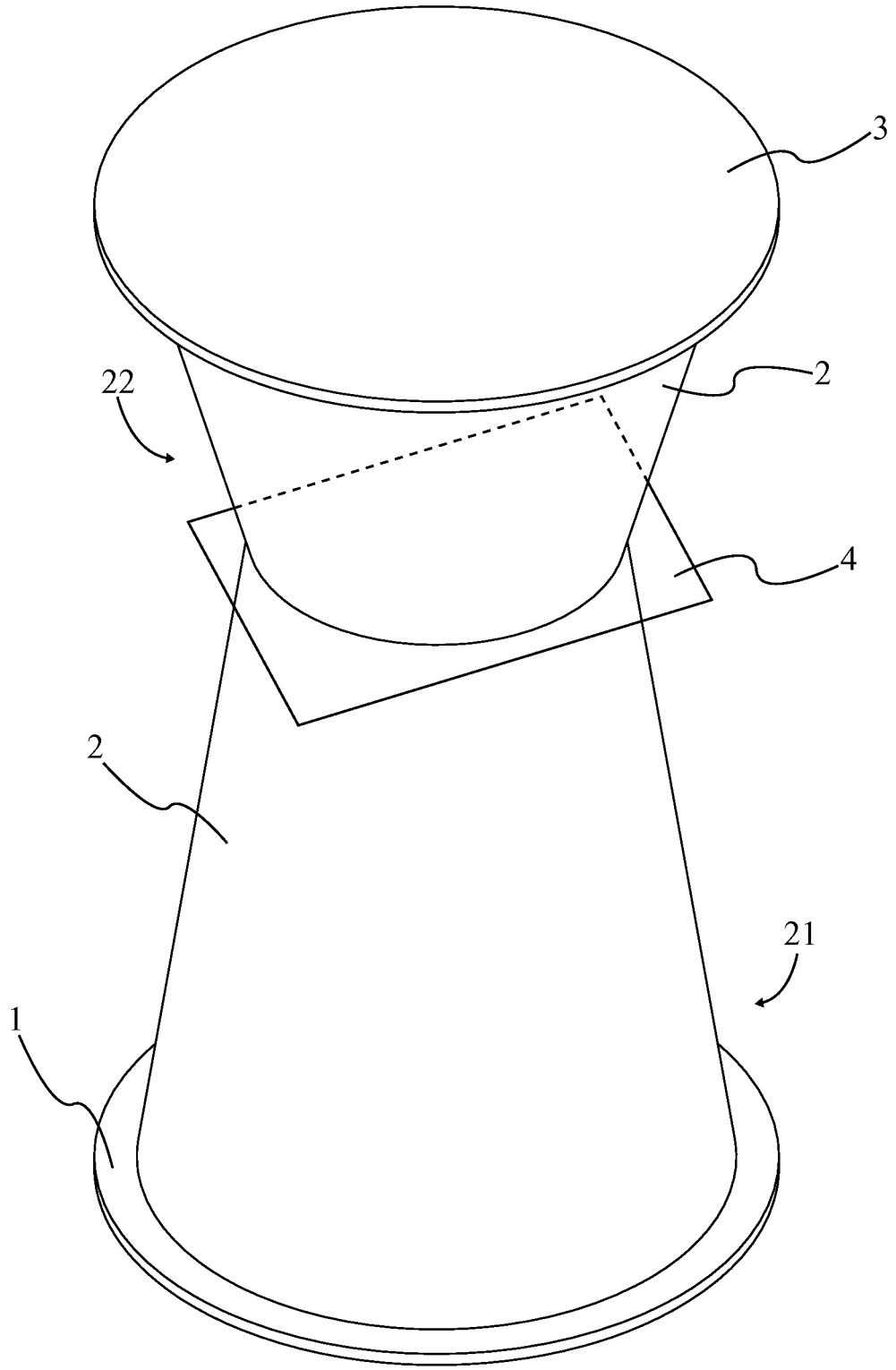
FIG. 5 is a perspective view showing an asymmetrical variant thereof.
Figure 6:
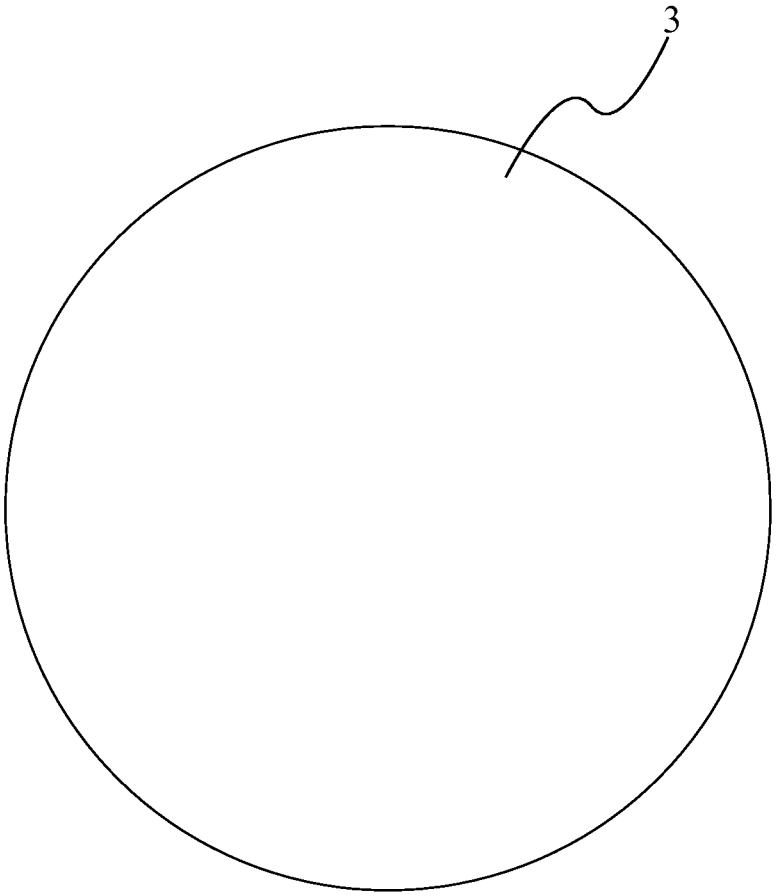
FIG. 6 is a top view showing a secondary rim of the present invention.
Figure 7:
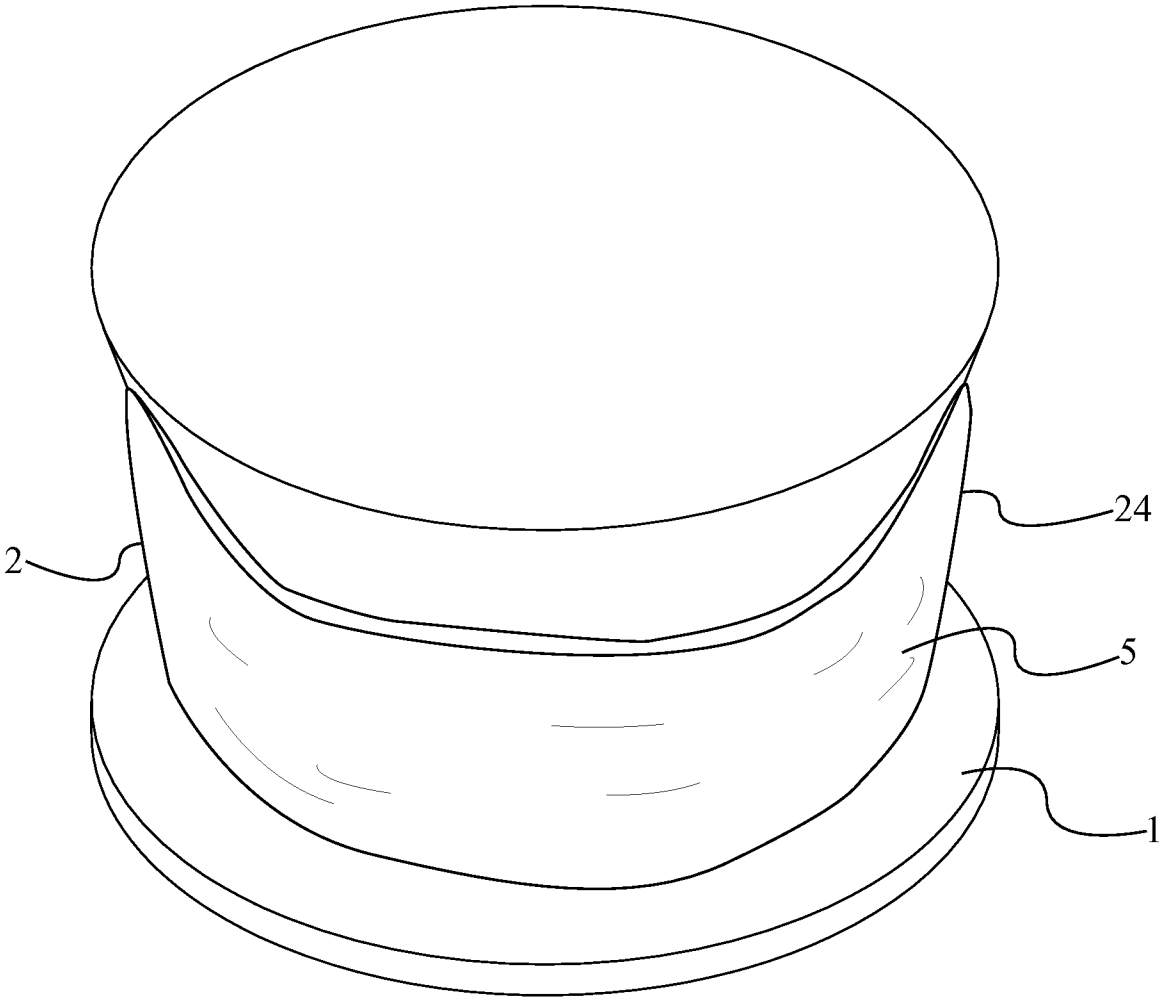
FIG. 7 is a perspective view showing a hair band positioned around one embodiment of the present invention.

For the described second embodiment, a secondary rim 3 is also possible. This secondary rim 3 parallels the base rim 1, being adjacently connected to an edge of the upper body section 22. Provided that the upper body section 22 and the lower body section 21 are mirror images of each other, the secondary rim 3 is also congruent with the base rim 1. That is, if overlapped they would have the same size and shape. If the upper body section 22 is not a reflection of the lower body section 21, the secondary rim 3 can be bigger or smaller than the base rim 1, corresponding with the relative size of the upper body section 22 to the lower body section 21. Just as the base rim 1 is concentric with the lower body section 21, the secondary rim 3 is correspondingly concentric with the upper body section 22. The second embodiment is shown in FIG. 4-FIG. 6.

Ideally, if utilized, the secondary rim 3 is configured to be coplanar with the base rim 1. The result is that the base rim 1 and secondary rim 3 are, in a sense, reversible. By flipping the present invention about the reference axis 4, the secondary rim 3 could be thought of as the base rim 1 and the upper body section 22 could be thought of the lower body section 21. Thus, either the base rim 1 or the secondary rim 3 could be placed next to the user's head, with a gap separating the present invention and the user's head. The hairstyle (e.g. ponytail) would thus be lying away from the user's head. This reversible nature makes the second embodiment of the present invention more user friendly. It is noted that the reversible property of the second embodiment does not apply to the first embodiment, which ideally comprises the base rim 1 as opposed to the base rim 1 and a secondary rim 3.

Both embodiments of the present invention are intended to be used in conjunction with a hair-retaining addition 5, e.g. a hair hand, scrunchie, or similar item. As the body 2 is used to enhance the volume of a selected hairstyle, the hair-retaining addition 5 secures the hair around the body 2. For example, a pony tail is formed around the body 2, and then a hair band or similar item is placed over the ponytail and around the body 2, thus holding the ponytail in position. The hair-retaining addition 5 is prevented from moving thanks to the tapered lower body section 21 and the rim; the rim acts as a wall that prevents further movement of the hair-retaining addition 5 in one direction, while the tapered section inhibits movement of a hair band due by means of the increasing radius. The hair-retaining addition 5 is thus prevented from shifting out of a small section between the base rim 1 and the upper body section 22. In the variant of the first embodiment that has a straight-walled cylindrical body 2, the hair-retaining addition 5 is preventing from sliding primarily by friction, as there is no tapered section to restrain movement. This hair-retaining addition 5 is shown around the body 2 in FIG. 7.

In the second embodiment the hair-retaining addition 5 is prevented from moving due to the tapered nature of both the lower body section 21 and the upper body section 22. The base rim 1 and potential secondary rim 3 further limit movement of the hair-retaining addition 5, ensuring the body 2 is securely integrated with the hairstyle it is enhancing.

In both embodiments, different construction methods, dimensions, arrangements, and even minor adjustments to shape can be made without departing from the scope of the present invention. For example, in both embodiments the body 2 can be built with a hollow interior in order to reduce the weight of the present invention. Additionally, the length of the body 2, including component lower body section 21 and upper body section 22, as well as the radius of the base rim 1 and second rim may be varied. Likewise, in variations where the lower body section 21, upper body section 22, or both are tapered, they may instead be curved rather than being linear.

For the second embodiment, which can be produced in a symmetrical or asymmetrical variant, there are preferences relating to dimensions. With regards to the asymmetrical variant, the lower body section 21 is preferably shorter than the upper body section 22. The symmetrical variant is preferably shorter than the asymmetrical version as a lengthy lower body section 21 is unwieldy and undesirable.

Figure 8:
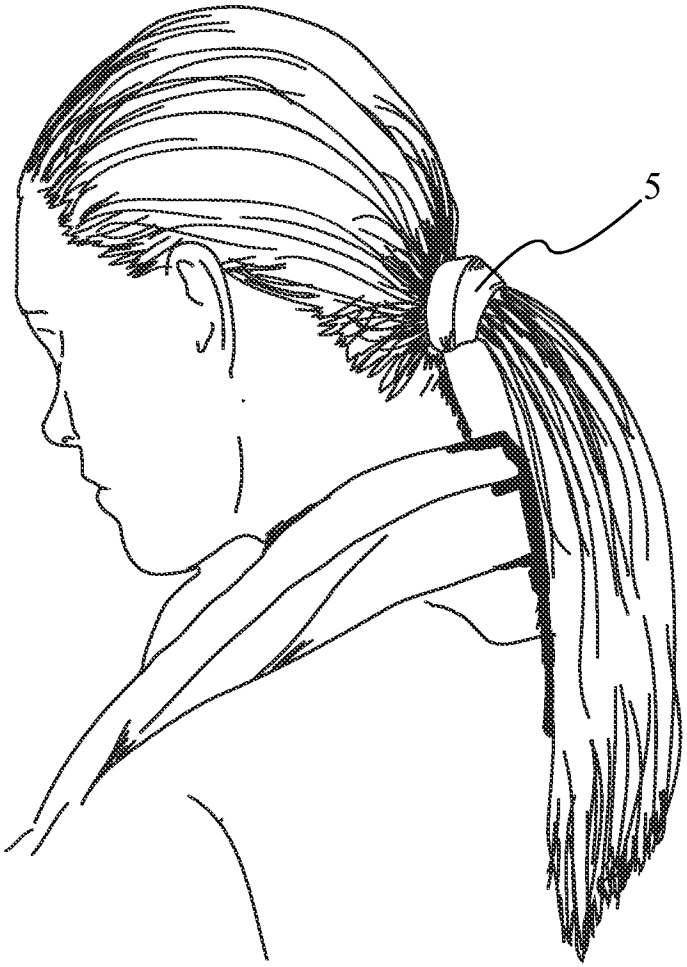
FIG. 8 is an illustration showing a ponytail hairstyle that is not utilizing the present invention.
Figure 9:
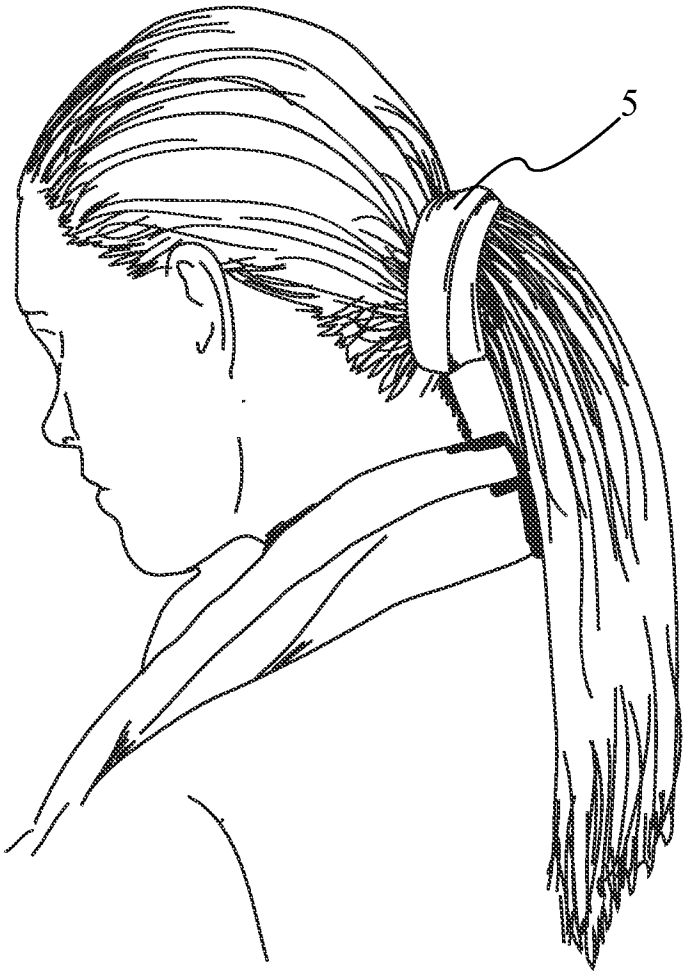
FIG. 9 is an illustration showing a ponytail hairstyle that is being enhanced by the present invention.
Figure 10:
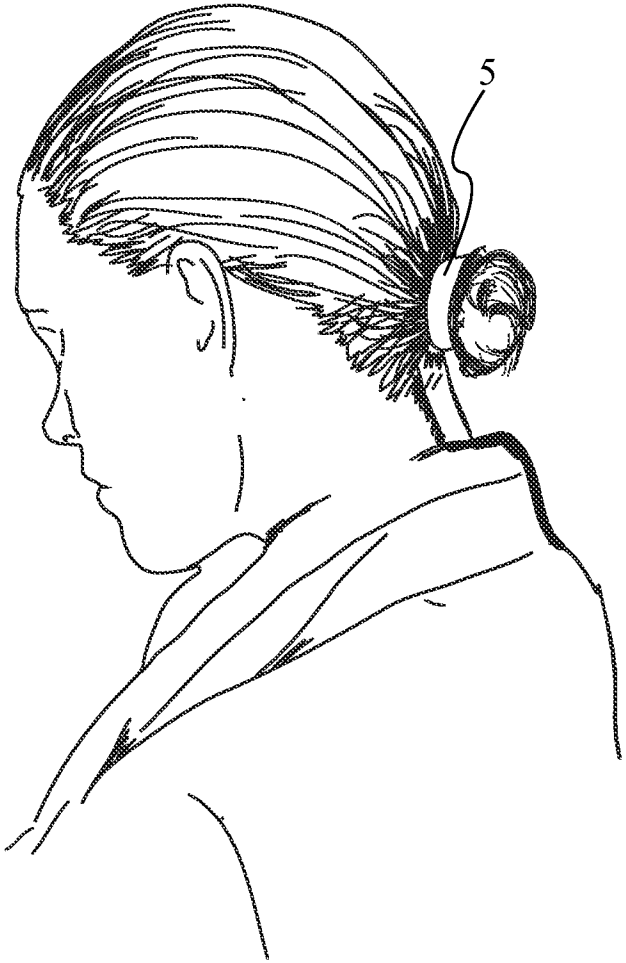
FIG. 10 is an illustration showing a ponytail hairstyle that is not utilizing the present invention.
Figure 11:
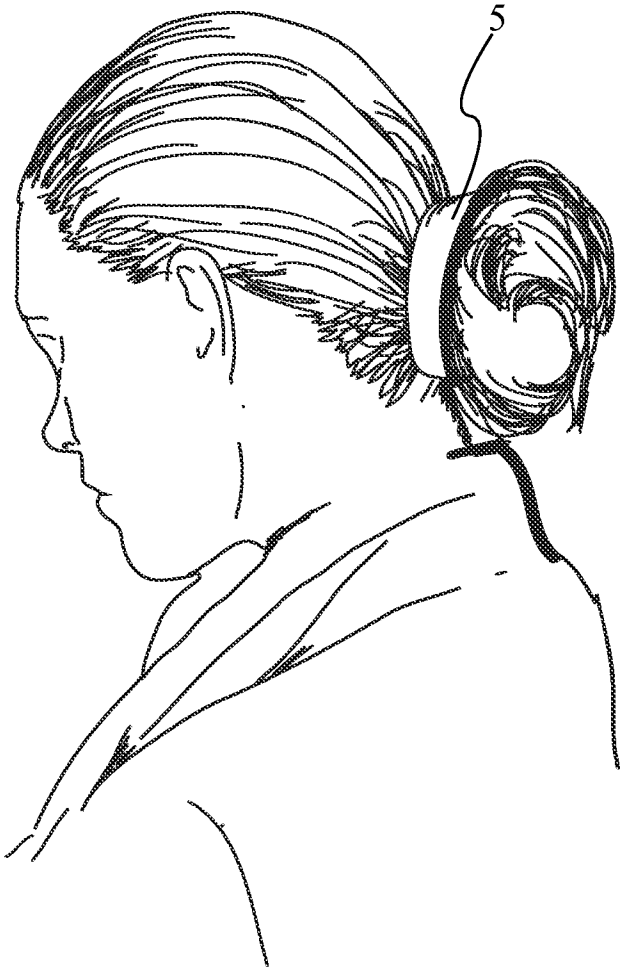
FIG. 11 is an illustration showing a ponytail hairstyle that is being enhanced by the present invention.

As earlier mentioned, both embodiments (along with their possible variants) are provided in order to help enhance a hairstyle in conjunction with a hair band or similar item. By forming the desired hairstyle around the body 2, the perceived size of the hairstyle is increased. FIG. 8 and FIG. 9 show the effects of the present invention by comparing a normal ponytail (FIG. 8) to one formed with the present invention (FIG. 9). FIG. 10 and FIG. 11 are similar in that they contrast a bun hairstyle formed without the present invention (FIG. 10) and with the present invention (FIG. 11). Though the present invention itself, especially the body 2, can be constructed with varying dimensions, it is preferably compact enough that it is hidden within a created hairstyle. For example, if used to help create and enlarge a ponytail, the base rim 1, body 2, and secondary rim 3 (in appropriate embodiments) would not be visible through the user's hair. The compact nature of the present invention also allows it to work more effectively with persons who have thin or fine hair, as such hair is less capable of concealing the present invention than that of persons with thicker hair.

Potential alterations to the shape and body 2 of the present invention include widening or shortening different sections of the body 2, as well as using different geometric shapes (e.g. a triangle or square instead of an ovoid) when forming the base rim 1 and body 2. As an example, the lower body section 21 and the upper body section 22 could be compressed and elongated, effectively flattening the body 2 and shortening the present invention (as measured from the base rim 1 to the upper body section 2). This shape would allow a user to create a ponytail with a "waterfall effect", where the ponytail has an increased width compared to a traditional ponytail which is narrower and rounder.

Although the invention has been explained in relation to its preferred embodiment, it is to be understood that many other possible modifications and variations can be made without departing from the spirit and scope of the invention as hereinafter claimed.

What is claimed is:

1. A hairstyle enhancing accessory to be worn by a user comprising:

a body for shaping the user's hair, the body further comprising a flat upper surface, a lower surface, and an outer wall, the outer wall having a unitary and unbroken outer surface around the perimeter of the body that extends from the flat upper surface to the lower surface;

a base with a front flat surface rigidly affixed to and concentric with the lower surface of the body and a rear surface adapted for placement against the user's head, wherein the base is solid; and a hair-retaining addition, the hair-retaining addition being positioned around the perimeter of a portion of the outer wall for holding the user's hair along the body, wherein the front flat surface of the base extends beyond the lower surface of the body to form a lip that completely surrounds the lower surface of the body, and wherein the outer wall of the body continuously tapers inwardly from the upper surface of the body to the lower surface of the body, such that the body is entirely frustoconical.

2. The hairstyle enhancing accessory as claimed in claim 1, wherein the body is substantially hollow.

3. The hairstyle enhancing accessory as claimed in claim 1, wherein the hair-retaining addition is a hair band.

4. A hairstyle enhancing accessory to be worn by a user comprising: a body for shaping the user's hair, the body further comprising a flat upper surface, a lower surface, and an outer wall, the outer wall having a unitary and unbroken outer surface around the perimeter of the body that extends from the flat upper surface to the lower surface;

a base with a front surface rigidly affixed to and concentric with the lower surface of the body and a rear surface adapted for placement against the user's head, wherein the base is solid; and a hair-retaining addition, the hair-retaining addition being positioned around the perimeter of a portion of the outer wall for holding the user's hair along the body, wherein the front surface of the base extends at a sharp angle relative to the outer wall and extends beyond the lower surface of the body to form a lip that completely surrounds the lower surface of the body, and wherein the outer wall of the entire body continuously tapers inwardly from the upper surface of the body to the lower surface of the body.

5. The hairstyle enhancing accessory as claimed in claim 4, wherein the body is substantially hollow.

6. The hairstyle enhancing accessory as claimed in claim 4, wherein the hair-retaining addition is a hair band.

7. The hairstyle enhancing accessory as claimed in claim 4, wherein the base and the upper surface of the body share a geometric shape.

8. The hairstyle enhancing accessory as claimed in claim 7, wherein the geometric shape is selected from the group consisting of square, circle, and triangle.

* * * * *